US009371990B2

(12) United States Patent
Moran et al.

(10) Patent No.: US 9,371,990 B2
(45) Date of Patent: Jun. 21, 2016

(54) ELLIPTICAL AIR OPENING AT AN UPSTREAM END OF A FUEL INJECTOR SHROUD AND A GAS TURBINE ENGINE COMBUSTION CHAMBER

(71) Applicant: ROLLS-ROYCE PLC, London (GB)

(72) Inventors: Anthony John Moran, Nuneaton (GB); Christopher Luke Ford, Dulverton (GB); Jonathan Frederick Carrotte, Kirby Muxloe (GB); Alastair Duncan Walker, Loughborough (GB)

(73) Assignee: ROLLS-ROYCE plc, London (GB)

( * ) Notice: Subject to any disclaimer, the term of this patent is extended or adjusted under 35 U.S.C. 154(b) by 443 days.

(21) Appl. No.: 14/090,755

(22) Filed: Nov. 26, 2013

(65) Prior Publication Data

US 2014/0157781 A1 Jun. 12, 2014

(30) Foreign Application Priority Data

Dec. 12, 2012 (GB) ..... 1222304.6

(51) Int. Cl.
*F23D 14/08* (2006.01)
*F23D 11/38* (2006.01)
(Continued)

(52) U.S. Cl.
CPC ..... *F23D 11/383* (2013.01); *F23R 3/14* (2013.01); *F23R 3/286* (2013.01); *F05D 2250/14* (2013.01); *F05D 2250/141* (2013.01); *F23D 2900/11101* (2013.01); *F23D 2900/11403* (2013.01); *F23R 3/02* (2013.01); *F23R 3/16* (2013.01); *F23R 3/343* (2013.01)

(58) Field of Classification Search
CPC ..... F23D 11/383; F23R 3/02; F23R 3/14; F23R 3/286; F23R 3/343; F05D 2250/14; F05D 2250/141
See application file for complete search history.

(56) References Cited

U.S. PATENT DOCUMENTS 4,218,020 A * 8/1980 Reider ..... F23R 3/14 239/406
5,351,475 A * 10/1994 Ansart ..... F23R 3/50 60/746

(Continued)

FOREIGN PATENT DOCUMENTS

EP 0 598 662 A1 5/1994
WO WO 00/11403 A1 3/2000

OTHER PUBLICATIONS

Jun. 7, 2013 British Search Report issued in British Application No. 1222304.6.

(Continued)

*Primary Examiner* — Lorne Meade
(74) *Attorney, Agent, or Firm* — Oliff PLC

(57) ABSTRACT

A gas turbine engine lean burn fuel injector includes a fuel injector head which has a first air swirler, a second air swirler arranged around the first air swirler, a pilot fuel injector arranged radially between the first air swirler and the second air swirler. A third air swirler arranged around the second air swirler, a fourth air swirler arranged around the third air swirler and a main fuel injector arranged radially between the third air swirler and the fourth air swirler. A shroud is arranged around the fourth air swirler. A downstream end of the shroud is generally circular in cross-section in a plane perpendicular to the axis (Y) of the fuel injector head and an upstream end of the shroud is generally elliptical in cross-section in a plane perpendicular to the axis (Y) of the fuel injector head.

21 Claims, 4 Drawing Sheets

(51) Int. Cl.

| | |
|---|---|
| ***F23R 3/28*** | (2006.01) |
| ***F23R 3/14*** | (2006.01) |
| *F23R 3/02* | (2006.01) |
| *F23R 3/34* | (2006.01) |
| *F23R 3/16* | (2006.01) |

(56) References Cited

U.S. PATENT DOCUMENTS

| | | | | |
|---|---|---|---|---|
| 5,392,720 | A * | 2/1995 | Briggs | F23D 1/02 110/264 |
| 6,038,861 | A | 3/2000 | Amos et al. | |
| 6,119,459 | A * | 9/2000 | Gomez | F23C 7/004 60/748 |
| 6,676,048 | B1 * | 1/2004 | Tiemann | F23D 11/38 239/533.12 |
| 6,772,594 | B2 * | 8/2004 | Nishida | F23F 3/002 60/737 |
| 7,788,927 | B2 * | 9/2010 | McMasters | F23R 3/283 6/739 |
| 7,921,650 | B2 * | 4/2011 | Oda | F23D 11/383 60/737 |
| 9,310,073 | B2 * | 4/2016 | Buelow | F23D 11/107 |
| 2008/0184708 | A1 | 8/2008 | Moriwaki et al. | |
| 2009/0255120 | A1 * | 10/2009 | McMasters | F23D 11/383 60/739 |
| 2010/0064691 | A1 | 3/2010 | Laster et al. | |
| 2010/0269506 | A1 | 10/2010 | Nonaka et al. | |
| 2010/0319350 | A1 | 12/2010 | Landry et al. | |
| 2012/0151928 | A1 * | 6/2012 | Patel | F23D 11/383 60/737 |
| 2012/0151930 | A1 | 6/2012 | Patel et al. | |
| 2012/0228405 | A1 * | 9/2012 | Buelow | F23R 3/28 239/463 |
| 2012/0305673 | A1 * | 12/2012 | Matsuyama | F23R 3/343 239/533.2 |

OTHER PUBLICATIONS

European Search Report issued in European Patent Application No. EP 13 00 5532 on Jul. 25, 2014.

* cited by examiner

ELLIPTICAL AIR OPENING AT AN UPSTREAM END OF A FUEL INJECTOR SHROUD AND A GAS TURBINE ENGINE COMBUSTION CHAMBER

The present invention relates to a fuel injector and to a gas turbine engine combustion chamber.

Conventionally fuel is supplied into a gas turbine engine combustion chamber via a plurality of fuel injectors. In an annular combustion chamber each fuel injector is located in a respective one of a plurality of apertures in an upstream end of the combustion chamber.

One type of gas turbine engine combustion chamber is known as a rich burn combustion chamber and another type of gas turbine engine combustion chamber is known as a lean burn combustion chamber. In a lean burn type of combustion chamber the fuel and air is mixed such that the fuel to air equivalence ratio is less than one.

One type of fuel injector for a lean burn type of combustion chamber comprises a pilot fuel injector and a main fuel injector. The pilot fuel injector is provided between two sets of air swirlers and the main fuel injector is provided between a further two sets of air swirlers. Generally the pilot fuel injector and the main fuel injector are arranged concentrically and the main fuel injector is arranged around the pilot fuel injector. The first two sets of air swirlers provide swirling flows of air which atomise the fuel from the pilot fuel injector and the second two sets of air swirlers provide swirling flows of air which atomise the fuel from the main fuel injector. Each air swirler comprises a plurality of circumferentially spaced radially extending swirl vanes and the swirl vanes extend between concentric members. The four sets of air swirlers are arranged concentrically.

A problem with the fuel injectors is that the fuel injectors do not take account of the effects of the air flow conditions upstream of the fuel injectors. For example the air flow to the fuel injectors has to be redistributed from an annular flow path to each of the plurality of fuel injectors. Additionally, due to the relatively large size of the fuel injectors there is a geometric disparity between them and the smaller exit height, smaller exit radius, of the pre-diffuser at an outlet of a compressor upstream of the combustion chamber. This causes increased total pressure loss and results in a non-uniform flow of air to the fuel injectors. This non-uniform flow of air to the fuel injectors in turn impacts both the local fuel to air ratio and the fuel atomisation process and ultimately this affects the emissions from the combustion chamber and hence the gas turbine engine and any increases in total pressure loss has an adverse affect on the specific fuel consumption of the gas turbine engine. Furthermore, as the air flow fraction flowing through the fuel injectors increases, leading to larger fuel injectors to maintain an acceptable combustion chamber pressure drop, the above problems are exacerbated. In addition air which has interacted with the standing vortices within the dump cavity will also flow through the fuel injectors. Thus, air which has poor flow quality, and which is inherently unstable, flows through the fuel injectors and compromises the temporal performance of the combustion chamber.

The present invention seeks to provide a novel fuel injector which reduces, preferably overcomes, the abovementioned problem.

Accordingly the present invention provides a fuel injector comprising a main fuel injector and at least one air swirler, wherein a shroud is arranged around the main fuel injector and at least one air swirler, the fuel injector has an axis, the shroud has a radially inner surface, the radially inner surface of the shroud is generally circular in cross-section in a plane perpendicular to the axis of the fuel injector at the downstream end of the shroud, the radially inner surface of the shroud is generally non-circular in cross-section in a plane perpendicular to the axis of the fuel injector at the upstream end of the shroud and has different dimensions in two mutually perpendicular directions.

The radially inner surface of the shroud may be generally elliptical, oval, kidney shaped, oblong or rectangular in cross-section in plane perpendicular to the axis of the fuel injector at the upstream end of the shroud.

The radially inner surface of the shroud changes from being circular in cross-section in a plane perpendicular to the axis of the fuel injector at the downstream end of the shroud to being generally elliptical, oval, kidney shaped, oblong or rectangular in cross-section in a plane perpendicular to the axis of the fuel injector at the upstream end of the shroud.

The fuel injector may comprise a first air swirler, a second air swirler arranged around the first air swirler, a pilot fuel injector arranged radially between the first air swirler and the second air swirler, a third air swirler arranged around the second air swirler, a fourth air swirler arranged around the third air swirler and the main fuel injector arranged radially between the third air swirler and the fourth air swirler, wherein the shroud is arranged around the fourth air swirler.

A member may be arranged between the third air swirler and the fourth air swirler.

The member may have a radially outer surface, the radially outer surface of the member is generally circular in cross-section in a plane perpendicular to the axis of the fuel injector at the downstream end of the member, the radially outer surface of the member is generally non-circular in cross-section in a plane perpendicular to the axis of the fuel injector at the upstream end of the member and has different dimensions in two mutually perpendicular directions.

The radially outer surface of the member may be generally elliptical, oval, kidney shaped, oblong or rectangular in cross-section in a plane perpendicular to the axis of the fuel injector at the upstream end of the member.

The member may have a radially inner surface, the radially inner surface of the member is generally circular in cross-section in a plane perpendicular to the axis of the fuel injector at the downstream end of the member, the radially inner surface of the member is generally non-circular in cross-section in a plane perpendicular to the axis of the fuel injector at the upstream end of the member and has different dimensions in two mutually perpendicular directions.

The radially inner surface of the member may be generally elliptical, oval, kidney shaped, oblong or rectangular in cross-section in a plane perpendicular to the axis of the fuel injector at the upstream end of the member.

The upstream end of the member and the upstream end of the shroud may be arranged in a common plane arranged perpendicular to the axis of the fuel injector.

The member may have a radially outer surface, the radially outer surface of the member is generally circular in cross-section in a plane perpendicular to the axis of the fuel injector at the downstream end of the member, the radially outer surface of the member is generally circular in cross-section in a plane perpendicular to the axis of the fuel injector at the upstream end of the member.

The member may have a radially inner surface, the radially inner surface of the member is generally circular in cross-section in a plane perpendicular to the axis of the fuel injector at the downstream end of the member, the radially inner surface of the member is generally circular in cross-section in a plane perpendicular to the axis of the fuel injector at the upstream end of the member.

The upstream end of the member and the upstream end of the shroud may be arranged in planes arranged perpendicular to the axis of the fuel injector and the upstream end of the shroud is arranged in a plane upstream of the upstream end of the member.

The fuel injector may have at least one splitter between the second and third swirlers.

The fuel injector may have a first splitter and a second splitter between the second and third swirlers and a fifth air swirler is arranged between the first and second splitters.

The first splitter may converge at its downstream end.

The second splitter may diverge at its downstream end.

The present disclosure also provides a fuel injector comprising a first air swirler, a second air swirler arranged around the first air swirler, a pilot fuel injector arranged radially between the first air swirler and the second air swirler, a third air swirler arranged around the second air swirler, a fourth air swirler arranged around the third air swirler and a main fuel injector arranged radially between the third air swirler and the fourth air swirler, wherein a shroud is arranged around the fourth air swirler, the shroud has a radially inner surface, the radially inner surface of the shroud is generally circular in cross-section in a plane perpendicular to the axis of the fuel injector at the downstream end of the shroud, the radially inner surface of the shroud is generally non-circular in cross-section in a plane perpendicular to the axis of the fuel injector at the upstream end of the shroud and has different dimensions in two mutually perpendicular directions.

The radially inner surface of the shroud is generally elliptical, oval, kidney shaped, oblong or rectangular in cross-section in a plane perpendicular to the axis of the fuel injector at the upstream end of the shroud.

The present disclosure also provides a fuel injector comprising a first air swirler, a second air swirler arranged around the first air swirler, a pilot fuel injector arranged radially between the first air swirler and the second air swirler, a third air swirler arranged around the second air swirler, a fourth air swirler arranged around the third air swirler and a main fuel injector arranged radially between the third air swirler and the fourth air swirler, wherein a shroud is arranged around the fourth air swirler, the shroud has a radially inner surface, the radially inner surface of the shroud is generally circular in cross-section in a plane perpendicular to the axis of the fuel injector at the downstream end of the shroud, the radially inner surface of the shroud is generally elliptical in cross-section in a plane perpendicular to the axis of the fuel injector at the upstream end of the shroud.

The present disclosure also provides a fuel injector comprising a first air swirler, a second air swirler arranged around the first air swirler, a pilot fuel injector arranged radially between the first air swirler and the second air swirler, a third air swirler arranged around the second air swirler, a fourth air swirler arranged around the third air swirler and a main fuel injector arranged radially between the third air swirler and the fourth air swirler, wherein a shroud is arranged around the fourth air swirler, the shroud has an upstream end and a downstream end, the downstream end of the shroud is generally circular in cross-section in a plane perpendicular to the axis of the fuel injector and the upstream end of the shroud is generally elliptical in cross-section in a plane perpendicular to the axis of the fuel injector.

The present disclosure also provides a gas turbine engine combustion chamber having at least one fuel injector, the fuel injector comprising a main fuel injector and at least one air swirler, wherein a shroud is arranged around the main fuel injector and the at least one air swirler, the shroud has a radially inner surface, the radially inner surface of the shroud is generally circular in cross-section in a plane perpendicular to the axis of the fuel injector at the downstream end of the shroud, the radially inner surface of the shroud is generally non-circular in cross-section in a plane perpendicular to the axis of the fuel injector at the upstream end of the shroud and has different dimensions in two mutually perpendicular directions.

The radially inner surface of the shroud is generally elliptical, oval, kidney shaped, oblong or rectangular in cross-section in a plane perpendicular to the axis of the fuel injector at the upstream end of the shroud.

The fuel injector may comprise a first air swirler, a second air swirler arranged around the first air swirler, a pilot fuel injector arranged radially between the first air swirler and the second air swirler, a third air swirler arranged around the second air swirler, a fourth air swirler arranged around the third air swirler and a main fuel injector arranged radially between the third air swirler and the fourth air swirler, wherein the shroud is arranged around the fourth air swirler.

The present disclosure also provides a gas turbine engine combustion chamber having at least one fuel injector, the fuel injector comprising a first air swirler, a second air swirler arranged around the first air swirler, a pilot fuel injector arranged radially between the first air swirler and the second air swirler, a third air swirler arranged around the second air swirler, a fourth air swirler arranged around the third air swirler and a main fuel injector arranged radially between the third air swirler and the fourth air swirler, wherein a shroud is arranged around the fourth air swirler, the shroud has a radially inner surface, the radially inner surface of the shroud is generally circular in cross-section in a plane perpendicular to the axis of the fuel injector at the downstream end of the shroud, the radially inner surface of the shroud is generally elliptical in cross-section in a plane perpendicular to the axis of the fuel injector at the upstream end of the shroud.

The maximum dimension of the upstream end of the shroud may be arranged to extend generally tangentially or circumferentially with respect to the axis of the gas turbine engine.

BRIEF DESCRIPTION OF DRAWINGS

The present invention will be more fully described by way of example with reference to the accompanying drawings, in which.

Figure 1:
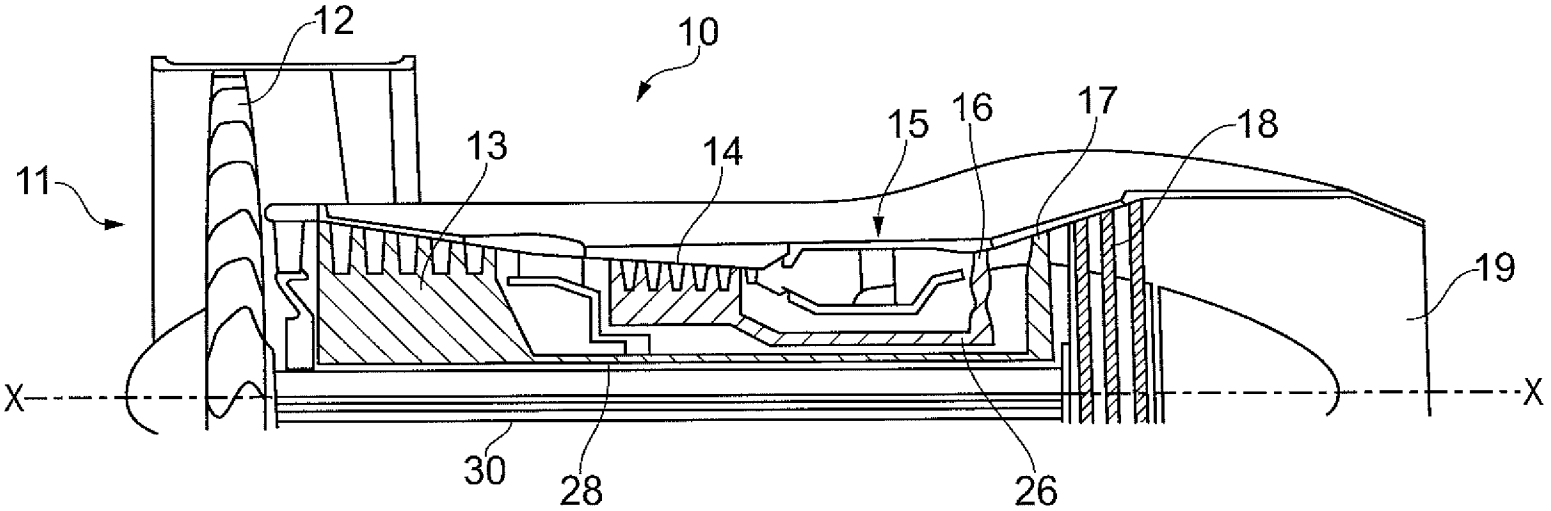
FIG. 1 is partially cut away view of a turbofan gas turbine engine having a fuel injector according to the present invention.

A turbofan gas turbine engine 10, as shown in FIG. 1, comprises in flow series an intake 11, a fan 12, an intermediate pressure compressor 13, a high pressure compressor 14, a combustion chamber 15, a high pressure turbine 16, an intermediate pressure turbine 17, a low pressure turbine 18 and an exhaust 19. The high pressure turbine 16 is arranged to drive the high pressure compressor 14 via a first shaft 26. The intermediate pressure turbine 17 is arranged to drive the intermediate pressure compressor 13 via a second shaft 28 and the low pressure turbine 18 is arranged to drive the fan 12 via a third shaft 30. In operation air flows into the intake 11 and is compressed by the fan 12. A first portion of the air flows through, and is compressed by, the intermediate pressure compressor 13 and the high pressure compressor 14 and is supplied to the combustion chamber 15. Fuel is injected into the combustion chamber 15 and is burnt in the air to produce hot exhaust gases which flow through, and drive, the high pressure turbine 16, the intermediate pressure turbine 17 and the low pressure turbine 18. The hot exhaust gases leaving the low pressure turbine 18 flow through the exhaust 19 to provide propulsive thrust. A second portion of the air bypasses the main engine to provide propulsive thrust. The fan 12, compressors 13 and 14 and the turbines 16, 17 and 18 rotate around the axis X of the turbofan gas turbine engine 10.

Figure 2:
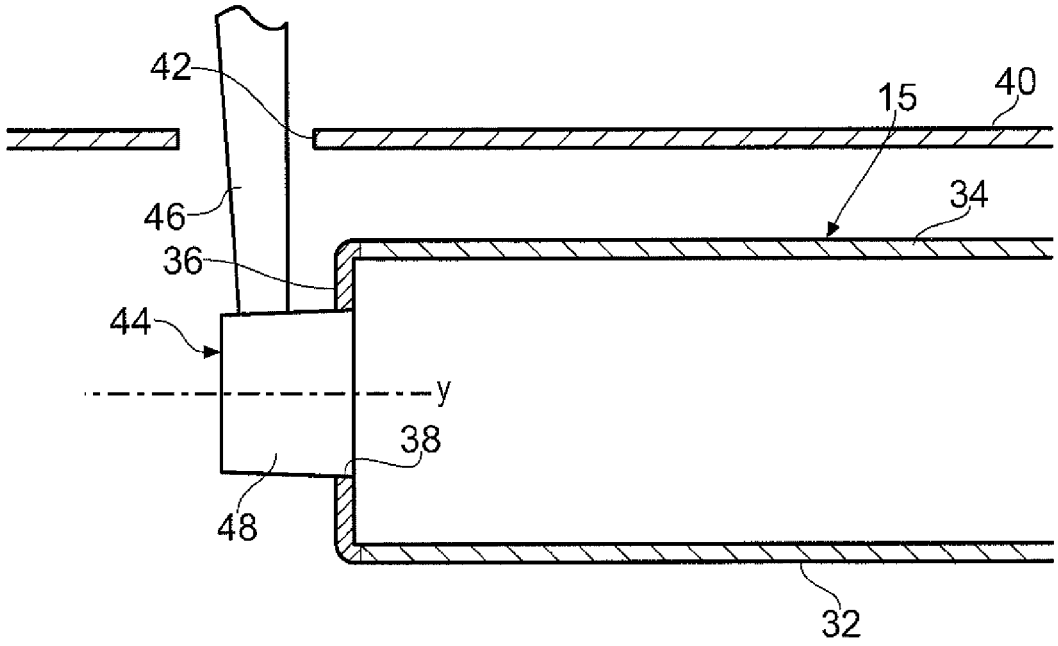
FIG. 2 is an enlarged perspective view of a gas turbine engine combustion chamber having a fuel injector according to the present invention.

The combustion chamber 15 is shown more clearly in FIG. 2. The combustion chamber 15 is an annular combustion chamber and comprises an inner annular wall 32, an outer annular wall 34 and an upstream wall 36. The upstream end wall 36 has a plurality of circumferentially spaced apertures, for example equi-circumferentially spaced apertures, 38. The combustion chamber 15 is surrounded by a combustion chamber casing 40 and the combustion chamber casing 40 has a plurality of circumferentially spaced apertures 42. The combustion chamber 15 also has a plurality of fuel injectors 44 and each fuel injector 44 extends radially through a corresponding one of the apertures 42 in the combustion chamber casing 40 and locates in a corresponding one of the apertures 38 in the upstream end wall 36 of the combustion chamber 15 to supply fuel into the combustion chamber 15.

Figure 5:
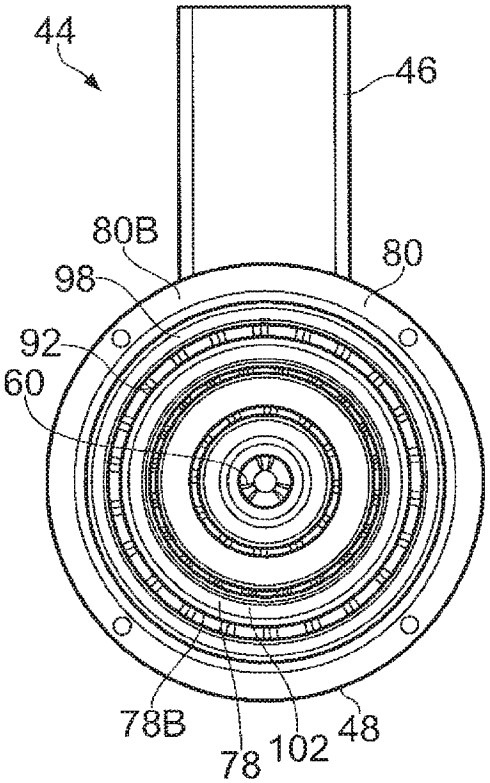
FIG. 5 is a view in the direction of arrow B in FIG. 3.
Figure 4:
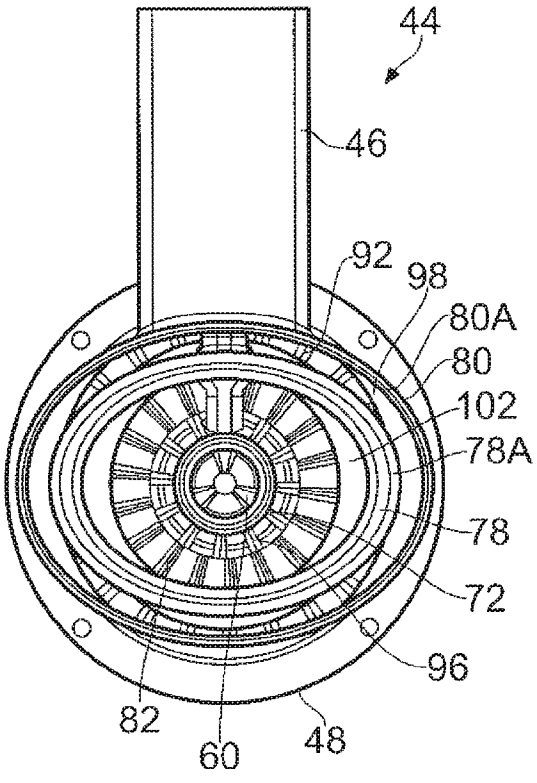
FIG. 4 is a view in the direction of arrow A in FIG. 3.
Figure 3:
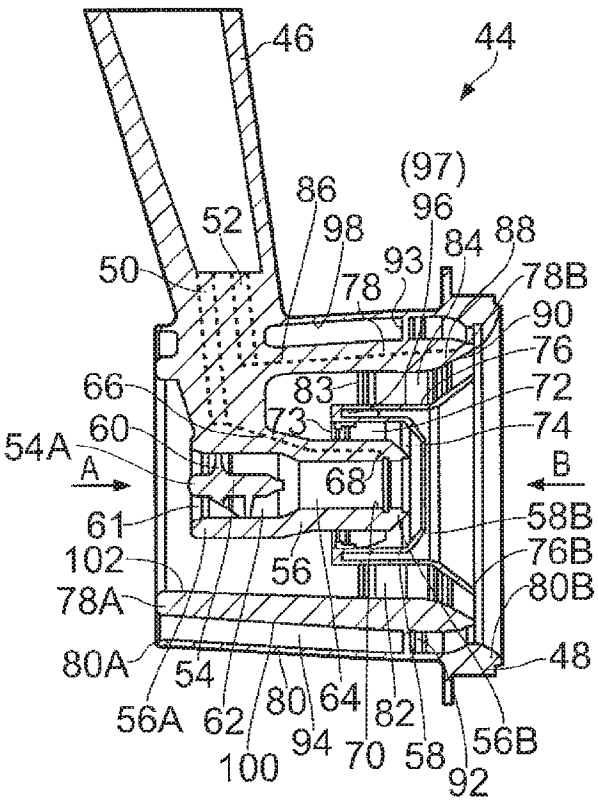
FIG. 3 is an enlarged cross-sectional view through a fuel injector according to the present invention.

A fuel injector 44 according to the present invention is shown more clearly in FIGS. 3 to 5. The fuel injector 44 comprises a fuel feed arm 46 and a fuel injector head 48. The fuel feed arm 46 has a first internal fuel passage 50 for the supply of pilot fuel to the fuel injector head 48 and a second internal fuel passage 52 for the supply of main fuel to the fuel injector head 48. The fuel injector head 48 has an axis Y and the fuel feed arm 46 extends generally radially with respect to the axis Y of the fuel injector head 48 and also generally radially with respect to the axis X of the turbofan gas turbine engine 10. The axis Y of each fuel injector head 48 is generally aligned with the axis of the corresponding aperture 38 in the upstream end wall 36 of the combustion chamber 15.

The fuel injector head 48 comprises a first generally cylindrical member 54, a second generally annular member 56 spaced coaxially around the first member 54 and a third generally annular member 58 spaced coaxially around the second member 56. A plurality of circumferentially spaced swirl vanes 60 extend radially between the first member 54 and the second member 56 to form a first air swirler 61. The second member 56 has a greater axial length than the first member 54 and the first member 54 is positioned at an upstream end 56A of the second member 56 and a generally annular duct 62 is defined between the first member 54 and the second member 56 and the swirl vanes 60 extend radially across the annular duct 62. A generally cylindrical duct 64 is defined radially within the second member 56 at a position downstream of the first member 54. The second member 56 has one or more internal fuel passages 66 which are arranged to receive fuel from the first internal fuel passage 50 in the fuel feed arm 46. The one or more fuel passages 66 are arranged to supply fuel to a fuel swirler 68 which supplies a film of fuel onto a radially inner surface 70 at a downstream end 56B of the second member 56. A plurality of circumferentially spaced swirl vanes 72 extend radially between the second member 56 and the third member 58 to form a second air swirler 73. The second member 56 has a greater axial length than the third member 58 and the third member 58 is positioned at the downstream end 56B of the second member 56 and a generally annular duct 74 is defined between the second member 56 and the third member 58 and the swirl vanes 72 extend across the annular duct 74. The downstream end 58B of the third member 58 is conical and is convergent in a downstream direction. The radially inner surface 70 of the second member 56, the radially outer surface of the second member 56 and the radially inner surface of the third member 58 are all circular in cross-section in a plane perpendicular to the axis Y of the fuel injector head 48 of the fuel injector 44. The downstream end 58B of the third member 58 is downstream of the downstream end 56B of the second member 56 and the downstream end 56B of the second member 56 is downstream of the downstream end 54B of the first member 54. In operation the pilot fuel supplied by internal fuel passages 66 and fuel swirler 68 onto the radially inner surface 70 of the second member 56 is atomised by swirling flows of air from the swirl vanes 60 and 72 of the first and second air swirlers 61 and 73 respectively.

The fuel injector head 48 also comprises a fourth generally annular member 76 spaced coaxially around the third member 58, a fifth member 78 spaced coaxially around the fourth member 76 and a sixth member 80 spaced coaxially around the fifth member 78. A plurality of circumferentially spaced swirl vanes 82 extend radially between the fourth member 76 and the fifth member 78 to form a third air swirler 83. The fifth member 78 has a greater axial length than the fourth member 76 and the fourth member 76 is positioned at the downstream end 78B of the fifth member 78 and a generally annular duct 84 is defined between the fourth member 76 and the fifth member 78 and the swirl vanes 82 extend across the annular duct 84. The fifth member 78 has one or more internal fuel passages 86 which are arranged to receive fuel from the second internal fuel passage 52 in the fuel feed arm 46. The one or more fuel passages 86 are arranged to supply fuel to a fuel swirler 88 which supplies a film of fuel onto the radially inner surface 90 at the downstream end 78B of the fifth member 78. A plurality of circumferentially spaced swirl vanes 92 extend radially between the fifth member 78 and the sixth member 80 to form a fourth air swirler 93. A generally annular duct 94 is defined between the downstream end 78B of the fifth member 78 and the downstream end 80B of the sixth member 80 and the swirl vanes 92 extend across the annular duct 94. The downstream end 76B of the fourth member 76 is conical and is divergent in a downstream direction. In operation the main fuel supplied by internal fuel passages 86 and fuel swirler 88 onto the radially inner surface 90 of the fifth member 78 is atomised by swirling flows of air from the swirl vanes 82 and 92 of the third and fourth air swirlers 83 and 93 respectively.

The fuel injector head 48 also comprises a plurality of circumferentially spaced swirl vanes 96 which extend radially between the third member 58 and the fourth member 76 to form a fifth air swirler 97. In operation the swirl vanes 96 of the fifth air swirler 97 provide a swirling flow of air over the radially inner surface of the fourth member 76.

The sixth member 80 has a radially inner surface 98, the radially inner surface 98 of the sixth member 80 is generally circular in cross-section in a plane perpendicular to the axis Y of the fuel injector head 48 of the fuel injector 44 at the downstream end 80B of the sixth member 80. In particular the radially inner surface 98 of the sixth member 80 is generally circular in cross-section in a plane perpendicular to the axis Y of the fuel injector head 48 of the fuel injector 44 downstream of the swirl vanes 92 of the fourth air swirler 93 and also is generally circular in cross-section in a plane perpendicular to the axis Y of the fuel injector head 48 of the fuel injector 44 immediately upstream of the swirl vanes 92 of the fourth air swirler 93. However, the radially inner surface 98 of the sixth member 80 is generally elliptical in cross-section in a plane perpendicular to the axis Y of the fuel injector head 48 of the fuel injector 44 at the upstream end 80A of the sixth member 80. The radially inner surface 98 of the sixth member 80 changes from being circular in cross-section in a plane perpendicular to the axis Y of the fuel injector head 48 of the fuel injector 44 at the downstream end 80B of the sixth member 80 to being generally elliptical in cross-section in a plane perpendicular to the axis Y of the fuel injector head 48 of the fuel injector 44 at the upstream end 80A of the sixth member 80. The downstream end 80B of the sixth member 80 converges to a minimum diameter at a plane arranged perpendicular to the axis Y of the fuel injector head 48 containing the downstream end 78B of the fifth member 78 and then diverges downstream of the downstream end 78B of the fifth member 78.

The fifth member 78 has a radially outer surface 100, the radially outer surface 100 of the fifth member 78 is generally circular in cross-section in a plane perpendicular to the axis Y of the fuel injector head 48 of the fuel injector 44 at the downstream end 78B of the fifth member 78. In particular the radially outer surface 100 of the fifth member 78 is generally circular in cross-section in a plane perpendicular to the axis Y of the fuel injector head 48 of the fuel injector 44 downstream of the swirl vanes 92 of the fourth air swirler 93 and also is generally circular in cross-section in a plane perpendicular to the axis Y of the fuel injector head 48 of the fuel injector 44 immediately upstream of the swirl vanes 92 of the fourth air swirler 93. The radially outer surface 100 of the fifth member 78 is generally elliptical in cross-section in a plane perpendicular to the axis Y of the fuel injector head 48 of the fuel injector 44 at the upstream end 78A of the fifth member 78. The radially outer surface 100 of the fifth member 78 changes from being circular in cross-section in a plane perpendicular to the axis Y of the fuel injector head 48 of the fuel injector 44 at the downstream end 78B of the fifth member 78 to being generally elliptical in cross-section in a plane perpendicular to the axis Y of the fuel injector head 48 of the fuel injector 44 at the upstream end 78A of the fifth member 78.

The fifth member 78 has a radially inner surface 102, the radially inner surface 102 of the fifth member 78 is generally circular in cross-section in a plane perpendicular to the axis Y of the fuel injector head 48 of the fuel injector 44 at the downstream end 78B of the fifth member 78. In particular the radially inner surface 102 of the fifth member 78 is generally circular in cross-section in a plane perpendicular to the axis Y of the fuel injector head 48 of the fuel injector 44 downstream of the swirl vanes 82 of the third air swirler 83 and also is generally circular in cross-section in a plane perpendicular to the axis Y of the fuel injector head 48 of the fuel injector 44 immediately upstream of the swirl vanes 82 of the third air swirler 83. The radially inner surface 102 of the fifth member 78 is generally elliptical in cross-section in a plane perpendicular to the axis Y of the fuel injector head 48 of the fuel injector 44 at the upstream end 78A of the fifth member 78. The radially inner surface 102 of the fifth member 78 changes from being circular in cross-section in a plane perpendicular to the axis Y of the fuel injector head 48 of the fuel injector 44 at the downstream end 78B of the fifth member 78 to being generally elliptical in cross-section in a plane perpendicular to the axis Y of the fuel injector head 48 of the fuel injector 44 at the upstream end 78A of the fifth member 78. The radially inner surface 102 at the downstream end 78B of the fifth member 78 diverges. The downstream ends 76B and 78B and of the fourth and fifth members 76 and 78 respectively are substantially in a common plane arranged perpendicular to the axis Y of the fuel injector head 48.

The upstream end 80A of the sixth member 80 is elliptical in a plane perpendicular to the axis Y of the fuel injector head 48 of the fuel injector 44 and the upstream end 78A of the fifth member 78 is elliptical in a plane perpendicular to the axis Y of the fuel injector head 48 of the fuel injector 44. The upstream end 78A of the fifth member 78 and the upstream end 80A of the sixth member 80 are arranged in a common plane arranged perpendicular to the axis Y of the fuel injector head 48 of the fuel injector 44. The upstream ends 78A and 80A of the fifth and sixth members 78 and 80 respectively are arranged in a plane perpendicular to the axis Y of the fuel injector head 48 of the fuel injector 44 which is upstream of the upstream ends 54A, 56A, 58A and 76A of the first, second, third and fourth members 54, 56, 58 and 76. The inlet to the duct defined by the upstream end 78A of the fifth member 78 has an elliptical cross-sectional area and this duct supplies air to the first, second, third and fifth air swirlers 61, 73, 83 and 97. The inlet to the duct defined between the upstream ends 78A and 80A of the fifth and sixth members 78 and 80 respectively has a cross-sectional area which is the difference of two elliptical cross-sectional areas and this duct supplies air to the fourth air swirler 93.

It is to be noted that the maximum dimension of the upstream end 80A of the sixth member 80 is arranged to extend generally tangentially or circumferentially with respect to the axis X of the turbofan gas turbine engine 10 and the maximum dimension of the upstream end 78A of the fifth member 78 is arranged to extend generally tangentially or circumferentially with respect to the axis of the gas turbine engine 10 or the major axis of the ellipses of the upstream ends 78A and 80A of the fifth and sixth members 78 and 80 respectively are arranged to extend generally tangentially or circumferentially with respect to the axis X of the turbofan gas turbine engine 10.

The third member 58 is also known as a first splitter, the fourth member 76 is also known as a second splitter and the sixth member 80 is also known as a shroud.

The fuel injector 44 of the present invention, as described, maintains a standard set of air swirlers 61, 73, 83 and 93 to atomise the supplies of pilot fuel 68 and main fuel 88 to the fuel injector 44 but modifies the geometry of the fuel injector head 48 upstream of the swirlers 61, 73, 83 and 93 to take into account the way the air is supplied from a compressor and a pre-diffuser upstream of the fuel injector 44 to the fuel injector 44. The fuel injector head 48 of the fuel injector 44 is modified by changing its inlet geometry to capture the air supplied from the pre-diffuser to provide an improved feed of air to the fuel injector head 48 and hence into the combustion chamber 15. The elliptical upstream ends 78A and 80A of the fifth and sixth members 78 and 80 respectively blend smoothly into circular downstream ends 78B and 80B respectively where the air swirlers 61, 73, 83 and 93 are located. The fuel injector 44 of the present invention has a better match to the air flow provided by the pre-diffuser and this results in a reduction in the pressure loss associated compared with the existing fuel injector and an increase in the uniformity of the airflow distribution compared with the existing fuel injector and hence a reduction in emissions.

Figure 8:
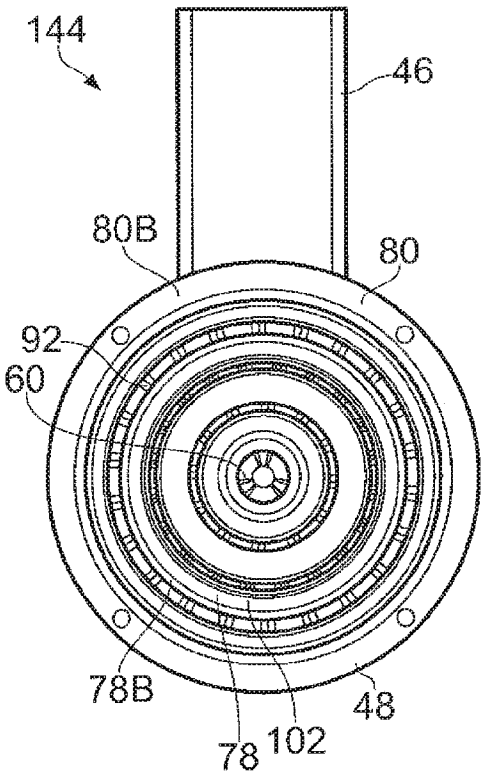
FIG. 8 is a view in the direction of arrow D in FIG. 6.
Figure 7:
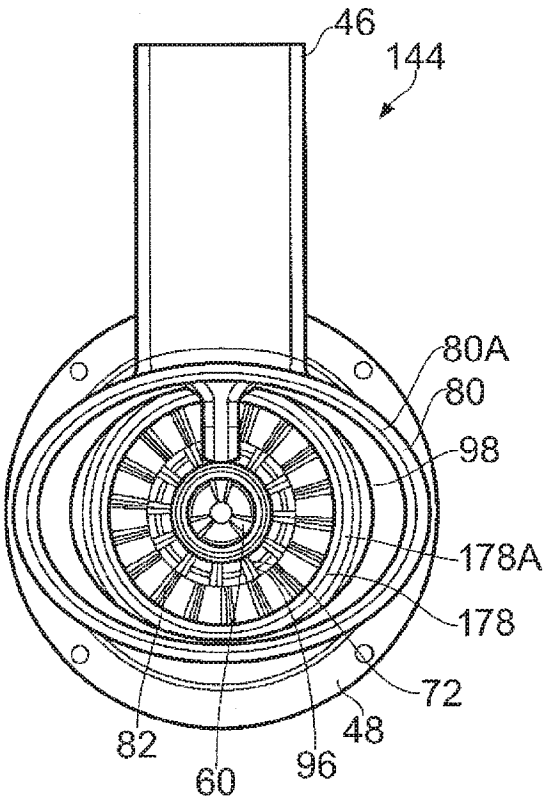
FIG. 7 is a view in the direction of arrow C in FIG. 6.
Figure 6:
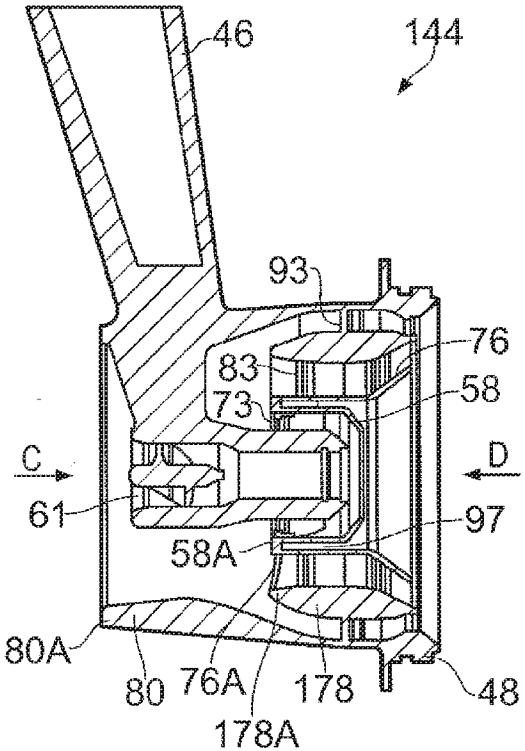
FIG. 6 is an enlarged cross-sectional view through an alternative fuel injector according to the present invention.

A further fuel injector 144 according to the present invention is shown more clearly in FIGS. 6 to 8. The fuel injector 144 is similar to the fuel injector 44 shown in FIGS. 3 to 5 and like parts are denoted by like numerals. The fuel injector 144 differs from the fuel injector 44 in that the fifth member 178 of the fuel injector 144 is different to the fifth member 78 of the fuel injector 44. In particular the upstream end 178A of the fifth member 178 and the upstream end 58A of the third member 58 are arranged in a common plane perpendicular to the axis Y of the fuel injector head 48. In addition the upstream end 178A of the fifth member 178 and the upstream end 76A of the fourth member 76 are arranged in a common plane perpendicular to the axis Y of the fuel injector head 48. In addition the upstream end 178A of the fifth member 178 is circular in cross-section in a plane perpendicular to the axis Y of the fuel injector head 48 and thus the inner and outer surfaces of the fifth member 178 are circular in cross-section in a plane perpendicular to the axis Y of the fuel injector head 48 at all axial positions.

The upstream end 80A of the sixth member 80 is elliptical in a plane perpendicular to the axis Y of the fuel injector head 48 of the fuel injector 144. The upstream end 80A of the sixth member 80 is arranged in a plane perpendicular to the axis Y of the fuel injector head 48 of the fuel injector 144 which is upstream of the upstream end 178A of the fifth member 178. The upstream end 80A of the sixth member 80 is also arranged in a plane perpendicular to the axis Y of the fuel injector head 48 of the fuel injector 144 which is also upstream of the upstream ends 54A, 56A, 58A and 76A of the first, second, third and fourth members 54, 56, 58 and 76. The inlet to the duct defined by the upstream end 80A of the sixth member 80 has an elliptical cross-sectional area and this duct supplies air to the first, second, third, fourth and fifth air swirlers 61, 73, 83, 93 and 97.

The fuel injector 144 provides an improvement over the fuel injector 44 by supplying all the air swirlers 61, 73, 83, 93 and 97 from the duct defined by the upstream end 80A of the sixth member 80. The dimensions of the upstream end 80A of the sixth member 80 are reduced compared to the upstream end 80A of the sixth member 80 of the fuel injector 44 and this enables the outer surface of the sixth member 80 to be more aerodynamic and results in further increases in uniformity of the airflow through the duct to the fourth air swirler 93.

It is to be noted again that the maximum dimension of the upstream end 80A of the sixth member 80 is arranged to extend generally tangentially or circumferentially with respect to the axis X of the turbofan gas turbine engine 10 or the major axis of the ellipse of the upstream end 80A of the sixth member 80 is arranged to extend generally tangentially or circumferentially with respect to the axis X of the turbofan gas turbine engine 10.

The fuel injectors according to the present invention provide better matching between the air flow from the compressor and pre-diffuser upstream of the fuel injectors and the combustion chamber downstream of the fuel injectors. The fuel injectors according to the present invention reduce the fuel injector pressure losses and increase the uniformity of the airflow feed to the fuel injectors thereby improving the emission characteristics of the combustion chamber, e.g. reducing the emission from the combustion chamber. The fuel injectors according to the present invention improve the pressure field entering the fuel injectors and this improves the airflow entering the fuel injectors. This results in improved mixing of the fuel and the air which in turn results in enhanced performance and a reduction in emissions. The improvement in the pressure loss leads to a fuel injector with smaller dimensions, lower weight and a reduction in the cross-sectional dimensions of the fuel feed arm compared to the conventional fuel injector.

In another embodiment of the present invention, not shown, the fuel injector may be substantially the same as that shown in FIGS. 3 to 5, but is not provided with a fourth member and a fifth air swirler. The third air swirler extends between the third member and the fifth member. In a further embodiment of the present invention, not shown, the fuel injector may be substantially the same as that shown in FIGS. 6 to 8, but it is not provided with a fourth member and a fifth air swirler. The third air swirler extends between the third member and the fifth member.

Thus the present invention provides a fuel injector comprising a first air swirler, a second air swirler arranged around the first air swirler, a pilot fuel injector arranged radially between the first air swirler and the second air swirler, a third air swirler arranged around the second air swirler, a fourth air swirler arranged around the third air swirler and a main fuel injector arranged radially between the third air swirler and the fourth air swirler, wherein a shroud is arranged around the fourth air swirler, the shroud has an upstream end and a downstream end, the downstream end of the shroud is generally circular in cross-section in a plane perpendicular to the axis of the fuel injector and the upstream end of the shroud is generally elliptical in cross-section in a plane perpendicular to the axis of the fuel injector. The maximum dimension of the upstream end of the shroud is arranged to extend tangentially or circumferentially with respect to the axis of the gas turbine engine and the minimum dimension of the upstream end of the shroud is arranged to extend radially with respect to the axis of the gas turbine engine.

Alternatively the present invention provides a fuel injector comprising a first air swirler, a second air swirler arranged around the first air swirler, a pilot fuel injector arranged radially between the first air swirler and the second air swirler, a third air swirler arranged around the second air swirler, a fourth air swirler arranged around the third air swirler and a main fuel injector arranged radially between the third air swirler and the fourth air swirler, wherein a shroud is arranged around the fourth air swirler, the shroud has an upstream end and a downstream end, the downstream end of the shroud is generally circular in cross-section in a plane perpendicular to the axis of the fuel injector and the upstream end of the shroud may be generally oval, oblong, rectangular or kidney shaped in cross-section in a plane perpendicular to the axis of the fuel injector.

The shroud generally gradually changes in shape in cross-section in a plane perpendicular to the axis of the fuel injector from an elliptical, oval, oblong, rectangular or kidney shape at the upstream end of the shroud to a circular shape at the downstream end of the shroud.

The upstream end of the shroud may have any other suitable non-circular shape which has different dimensions in two mutually perpendicular directions. The radially inner surface of the shroud at the upstream end of the shroud may as a consequence have any other suitable non-circular shape in cross-section in a plane perpendicular to the axis of the fuel injector which has different dimensions in two mutually perpendicular directions. The maximum, or greatest, dimension of the upstream end of the shroud is arranged to extend tangentially or circumferentially with respect to the axis of the gas turbine engine and the minimum dimension of the shroud is arranged to extend generally radially with respect to the axis of the gas turbine engine.

The downstream end of the member arranged between the third air swirler and the fourth air swirler is generally circular in cross-section in a plane perpendicular to the axis of the fuel injector and the upstream end of the member is generally elliptical in cross-section in a plane perpendicular to the axis of the fuel injector. The maximum dimension of the upstream end of the member is arranged to extend tangentially or circumferentially with respect to the axis of the gas turbine engine.

The downstream end of the member arranged between the third air swirler and the fourth air swirler is generally circular in cross-section in a plane perpendicular to the axis of the fuel injector and the upstream end of the member is generally oval, oblong, rectangular or kidney shaped in cross-section in a plane perpendicular to the axis of the fuel injector.

The member generally gradually changes in shape in cross-section in a plane perpendicular to the axis of the fuel injector from an elliptical, oval, oblong, rectangular or kidney shape at the upstream end of the member to a circular shape at the downstream end of the member.

The upstream end of the member may have any other suitable non-circular shape which has different dimensions in two mutually perpendicular directions. The radially inner and radially outer surfaces of the member at the upstream end of the member may as a consequence have any other suitable non-circular shape in cross-section in a plane perpendicular to the axis of the fuel injector which has different dimensions in two mutually perpendicular directions. The maximum dimension of the upstream end of the member is arranged to extend tangentially or circumferentially with respect to the axis of the gas turbine engine and the minimum dimension of the upstream end of the member is arranged to extend radially with respect to the axis of the gas turbine engine.

The upstream end of the shroud may also be defined by two coaxial radially spaced arcs and two circumferentially spaced radii. The upstream end of the member may also be defined by two coaxial radially spaced arcs and two circumferentially spaced radii.

Although the present invention has been described with reference to a particular type of fuel injector with a pilot fuel injector between two air swirlers and a main fuel injector between a further two air swirlers, the present invention is equally applicable to other types of fuel injectors with pilot and main fuel injectors with other arrangements of air swirlers and is also applicable to fuel injectors with only a main fuel injector and air swirlers if the fuel injectors have a relatively large size and there is a geometric disparity between the fuel injectors and a smaller exit height, smaller exit radius, of the pre-diffuser at an outlet of a compressor upstream of the combustion chamber.

The invention claimed is:

1. A fuel injector assembly comprising:

a main fuel injector;

a first air swirler;

a second air swirler arranged around the first air swirler;

a pilot fuel injector arranged radially between the first air swirler and the second air swirler;

a third air swirler arranged around the second air swirler;

a fourth air swirler arranged around the third air swirler, the main fuel injector arranged radially between the third air swirler and the fourth air swirler; and a shroud arranged around the fourth air swirler, the fuel injector assembly has a longitudinal axis, the shroud has a radially inner surface, the radially inner surface of the shroud defining a generally circular cross-sectional outlet in a downstream plane perpendicular to the longitudinal axis at a downstream end of the shroud, the radially inner surface of the shroud defining a generally non-circular cross-sectional opening in an upstream plane perpendicular to the longitudinal axis at an upstream end of the shroud, the generally non-circular cross-sectional opening having different dimensions in two mutually perpendicular directions in the upstream plane, wherein the upstream plane to the downstream plane defines an airflow direction.

2. A fuel injector assembly as claimed in claim 1 wherein the generally non-circular cross-sectional opening is selected from the group consisting of elliptical, oval, kidney shaped, oblong and rectangular openings in the upstream plane.

3. A fuel injector assembly as claimed in claim 2 wherein the radially inner surface of the shroud changes from being circular in cross-section in the downstream plane at the downstream end of the shroud to being the generally non-circular cross-sectional opening selected from the group consisting of elliptical, oval, kidney shaped, oblong and rectangular openings in the upstream plane.

4. A fuel injector assembly as claimed in claim 1, further comprising a member arranged between the third air swirler and the fourth air swirler.

5. A fuel injector assembly as claimed in claim 4 wherein the member has a radially outer surface, the radially outer surface of the member is generally circular in cross-section in a first plane perpendicular to the longitudinal axis at a downstream end of the member, the radially outer surface of the member is generally non-circular in cross-section in a second plane perpendicular to the longitudinal axis at an upstream end of the member, the radially outer surface of the member has different dimensions in two mutually perpendicular directions in the second plane.

6. A fuel injector assembly as claimed in claim 5 wherein the generally non-circular in cross-section radially outer surface of the member is selected from the group consisting of generally elliptical, oval, kidney shaped, oblong and rectangular in cross-section in the second plane at the upstream end of the member.

7. A fuel injector assembly as claimed in claim 5 wherein the member has a radially inner surface, the radially inner surface of the member is generally circular in cross-section in the first plane at the downstream end of the member, the radially inner surface of the member is generally non-circular in cross-section in the second plane at the upstream end of the member, the radially inner surface of the member has different dimensions in two mutually perpendicular directions in the second plane.

8. A fuel injector assembly as claimed in claim 7 wherein the generally non-circular in cross-section radially inner surface of the member is selected from the group consisting of generally elliptical, oval, kidney shaped, oblong and rectangular in cross-section in the second plane at the upstream end of the member.

9. A fuel injector assembly as claimed in claim 5 wherein the upstream end of the member and the upstream end of the shroud are arranged in a common plane arranged perpendicular to the longitudinal axis of the fuel injector assembly.

10. A fuel injector assembly as claimed in claim 4 wherein the member has a radially outer surface, the radially outer surface of the member is generally circular in cross-section in a first plane perpendicular to the longitudinal axis at a downstream end of the member, the radially outer surface of the member is generally circular in cross-section in a second plane perpendicular to the longitudinal axis at an upstream end of the member.

11. A fuel injector assembly as claimed in claim 5 wherein the member has a radially inner surface, the radially inner surface of the member is generally circular in cross-section in the first plane at the downstream end of the member, the radially inner surface of the member is generally circular in cross-section in the second plane at the upstream end of the member.

12. A fuel injector assembly as claimed in claim 5 wherein the second plane at the upstream end of the member is located downstream of the upstream plane at the upstream end of the shroud.

13. A fuel injector assembly as claimed in claim 1 further comprising:

at least one splitter arranged between the second swirler and the third swirler.

14. A fuel injector assembly as claimed in claim 13 wherein the at least one splitter comprises a first splitter and a second splitter arranged between the second swirler and the third swirler; and a fifth air swirler is arranged between the first splitter and the second splitter.

15. A fuel injector assembly as claimed in claim 14 wherein downstream end of the first splitter converges toward the longitudinal axis.

16. A fuel injector assembly as claimed in claim 14 wherein a downstream end of the second splitter diverges away from the longitudinal axis.

17. A gas turbine engine comprising the fuel injector assembly as claimed in claim 1.

18. A gas turbine engine combustion chamber having:

at least one fuel injector assembly, the fuel injector assembly comprising a main fuel injector having a longitudinal axis;

at least one air swirler; and a shroud arranged around the main fuel injector and the at least one air swirler, the shroud has a radially inner surface, the radially inner surface of the shroud defining a generally circular cross-sectional outlet in a downstream plane perpendicular to the longitudinal axis at a downstream end of the shroud, the radially inner surface of the shroud defining a generally non-circular cross-sectional opening in an upstream plane perpendicular to the longitudinal axis at an upstream end of the shroud, the generally non-circular cross-sectional opening having different dimensions in two mutually perpendicular directions in the upstream plane, the generally non-circular cross-sectional opening is one of an elliptical opening and an oval opening, wherein the upstream plane to the downstream plane defines an airflow direction.

19. A gas turbine engine combustion chamber as claimed in claim 18, the at least one air swirler further comprising a first air swirler, a second air swirler arranged around the first air swirler, a pilot fuel injector arranged radially between the first air swirler and the second air swirler, a third air swirler arranged around the second air swirler, and a fourth air swirler arranged around the third air swirler, the main fuel injector arranged radially between the third air swirler and the fourth air swirler, wherein the shroud is arranged around the fourth air swirler.

20. A gas turbine engine combustion chamber as claimed in claim 18 wherein a maximum dimension of the generally non-circular cross-sectional opening in the upstream plane is arranged to extend generally tangentially or circumferentially with respect to a circle that is coincident with a longitudinal axis of the gas turbine engine.

21. A fuel injector assembly comprising:

a main fuel injector having a longitudinal axis;

at least one air swirler; and a shroud arranged around the main fuel injector and the at least one air swirler, the shroud has a radially inner surface, the radially inner surface of the shroud defining a generally circular cross-sectional outlet in a downstream plane perpendicular to the longitudinal axis at a downstream end of the shroud, the radially inner surface of the shroud defining a generally elliptical cross-sectional inlet in an upstream plane perpendicular to the longitudinal axis at an upstream end of the shroud, wherein the upstream plane to the downstream plane defines an airflow direction.

* * * * *